US007137867B2

(12) United States Patent
Nagayama et al.

(10) Patent No.: US 7,137,867 B2
(45) Date of Patent: Nov. 21, 2006

(54) THICKNESS CONTROL METHOD AND DOUBLE SIDE POLISHER

(75) Inventors: Hitoshi Nagayama, Yokohama (JP); Yusuke Inoue, Zama (JP)

(73) Assignee: Speedfam Co., Ltd., Kanagawa (JP)

( * ) Notice: Subject to any disclaimer, the term of this patent is extended or adjusted under 35 U.S.C. 154(b) by 0 days.

(21) Appl. No.: 11/359,451

(22) Filed: Feb. 23, 2006

(65) Prior Publication Data

US 2006/0194512 A1 Aug. 31, 2006

(30) Foreign Application Priority Data

Feb. 25, 2005 (JP) ..... 2005-050297

(51) Int. Cl.
*B24B 49/00* (2006.01)

(52) U.S. Cl. ..... 451/5; 451/10; 451/11; 451/41; 451/262; 451/269; 451/287

(58) Field of Classification Search ..... 451/5, 451/8, 9, 10, 11, 41, 262, 268, 269, 285, 287, 451/288

See application file for complete search history.

(56) References Cited

U.S. PATENT DOCUMENTS

| | | | | |
|---|---|---|---|---|
| 4,272,924 | A * | 6/1981 | Masuko et al. | 451/1 |
| 4,433,510 | A * | 2/1984 | Katagiri et al. | 451/5 |
| 5,099,614 | A * | 3/1992 | Arai et al. | 451/8 |
| 6,062,949 | A * | 5/2000 | Yashiki et al. | 451/10 |
| 6,726,525 | B1 * | 4/2004 | Kato et al. | 451/5 |
| 6,887,127 | B1 * | 5/2005 | Nishikawa et al. | 451/6 |
| 7,001,242 | B1 * | 2/2006 | Birang et al. | 451/5 |
| 7,004,816 | B1 * | 2/2006 | Saitoh | 451/10 |
| 7,008,308 | B1 * | 3/2006 | Bjelopavlic et al. | 451/269 |
| 2002/0115387 | A1 * | 8/2002 | Wenski et al. | 451/41 |

FOREIGN PATENT DOCUMENTS

| | | |
|---|---|---|
| JP | 56-146666 | 11/1981 |
| JP | 57-076406 | 5/1982 |
| JP | 63-062673 | 3/1988 |
| JP | 02-224968 | 9/1990 |
| JP | 10-034529 | 2/1998 |
| JP | 10-202514 | 8/1998 |
| JP | 2000-127031 | 5/2000 |
| JP | 2003-117809 | 4/2003 |

* cited by examiner

*Primary Examiner*—Eileen P. Morgan
(74) *Attorney, Agent, or Firm*—Morrison & Foerster LLP

(57) ABSTRACT

The object of the present invention is to provide a thickness control method for a double side polisher, accuracy of which is not affected by wearing of polishing pad and applicable to polishing of nonconductive work pieces. An eddy current sensor in a cavity of an upper polishing plate measures distance from the senor to the upper surface of carrier with holes for the work pieces being inserted respectively. The measured distance is successively monitored and polishing is stopped when the distance has become a predetermined value corresponding to target amount of material removal from the work piece.

2 Claims, 4 Drawing Sheets

THICKNESS CONTROL METHOD AND DOUBLE SIDE POLISHER

This application is based on application No. 2005-050297 filed in Japan, the contents of which are hereby incorporated by reference.

FIELD OF THE INVENTION

The present invention relates to a double side polisher for a work piece and a thickness control method thereof.

BACKGROUND OF THE INVENTION

A double side polisher is a machine that polishes surfaces of both sides of a work piece at the same time. The work pieces are inserted in holes of a carrier respectively and the carrier with the work pieces is placed between upper and lower polishing plates on which polishing pads are plastered. Then, a planetary motion is provided to the carrier and a rotary motion is provided to the upper and lower polishing plates, while supplying slurry in the gap of the polishing plates and applying a predetermined polishing pressure to the work pieces by the polishing plates.

Although the amount of polishing of the work piece is usually monitored by means of polishing duration time, there is a case where it is necessary to detect the amount of polishing or material removal. Therefore, there are made some attempts to provide a thickness control device in a polishing apparatus.

Conventionally, there is known a thickness control device using a probe as disclosed in Japanese Examined Patent Publication No. S64-4126. The thickness control device disclosed in the document has a construction wherein a stylus of the probe is directed upward and the upper end of the stylus is in contact with the measurement chip fixed to the upper polishing plate. As the upper polishing plate goes down, with the advance of polishing, the chip of the upper polishing plate pushes down the stylus of the probe and the displacement, namely the amount of polishing, is measured by the probe.

Also there is known another thickness control device using an eddy current distance sensor as disclosed in Japanese Examined Patent Publication No. S63-9943. This device mounted on the upper polishing plate measures the change of distance from itself to the lower polishing plate by detecting the change of impedance of the sensor.

Furthermore, in the thickness control device disclosed in Japanese Unexamined Patent Publication No. H10-202514, a reference aluminum plate is provided on the carrier, and distance L1 to the upper surface of the reference plate and distance L2 to the upper surface of an aluminum disk, or a work piece, are measured by the eddy current sensor and a difference between distances L1 and L2 is calculated to determine the thickness of the aluminum disk (work piece).

SUMMARY OF THE INVENTION

In the first document, it is assumed that the amount of downward displacement of the upper polishing plate corresponds to the amount of material removal from the work piece. However, as the upper and lower polishing plates are worn while lapping operations are repeated, the displacement of the upper polishing plate becomes no longer correspond to the amount of material removal when many work pieces are polished. Thus accuracy of the thickness control falls gradually. Moreover, since the stylus is in contact with the chip, the contact end of the stylus is abraded by rotation of the chip and error in measurement may occur. Because of this, accuracy the thickness control is about ±4 to 5 μm and thus it is difficult to achieve an accuracy of ±3 μm or less.

In contrast, in the thickness control device using the eddy current sensor disclosed in the second Document, the distance between the upper and lower polishing plates is detected by radiating magnetic field from the eddy current sensor to the lower polishing plate, which allows for measurements including the wear of the lower polishing plate, and also allows the measurement of the work piece to an accuracy of ±3 μm or less, since measurement error decreases compared with the thickness control device disclosed in the first document. However, accuracy achieved by the above thickness control device is not enough to satisfy the level recently required as the measurement is influenced by deformation of polishing pad caused by polishing pressure.

The thickness control device disclosed in the third document is limited for electrical conductive materials and cannot be applied for polishing work pieces made of semiconductor, glass or crystal as they are not electrically conductive.

Therefore, an object of the present invention is to provide a thickness control method and device that can also be used for a work piece that is not conductive and is effectively not affected by wearing of polishing pad, and is capable of measuring with high accuracy.

The aforementioned problems can be solved by the following means. That is, the first aspect of the present invention is a thickness control method for a double side polisher having: a machine base; a lower polishing plate on the upper surface of which a polishing pad being attached rotatably supported on said machine base; a sun gear with external teeth rotatably supported on said machine base; an internal gear with internal teeth rotatably supported on said machine base; an electro-conductive carrier with external teeth for meshing with said external teeth of said sun gear and said internal teeth of said internal gear having holes for work pieces to be inserted therein; a rotatable upper polishing plate, on the lower surface of which a polishing pad being attached, for applying polishing pressure to said work pieces inserted in said holes; a drive system with a singularity of or a plurality of driving sources for rotating said upper and lower polishing plates, said sun gear and said internal gear around the same axis; a slurry supplying unit for supplying slurry to polishing area; and an eddy current sensor mounted in a cavity of said upper polishing plate for measuring distance to the upper surface of said carrier, said polisher stops polishing when distance to the upper surface of said carrier measured by said sensor has decreased by a predetermined value corresponding to a target amount of material removal from the work piece.

The second aspect of the present invention is a double side polisher comprising: a machine base; a lower polishing plate on the upper surface of which a polishing pad being attached rotatably supported on said machine base; a sun gear with external teeth rotatably supported on said machine base; an internal gear with internal teeth rotatably supported on said machine base; an electro-conductive carrier with external teeth for meshing with said external teeth of said sun gear and said internal teeth of said internal gear having holes for work pieces to be inserted therein; a rotatable upper polishing plate, on the lower surface of which a polishing pad being attached, for applying polishing pressure to said work pieces inserted in said holes; a drive system with a singularity of or a plurality of driving sources for rotating said upper and lower polishing plates, said sun gear and said internal gear around the same axis; a slurry supplying unit for supplying slurry to polishing area; an eddy current sensor mounted in a cavity of said upper polishing plate for measuring distance to the upper surface of said carrier; an initial value storage unit to store initial value of the distance from said sensor to the upper surface of said carrier measured at the beginning of polishing by said sensor; a comparator unit for successively comparing said initial value stored in said initial value storage unit with the distance currently measured by said sensor; and a control unit for stopping polishing when the difference calculated by said comparator unit has become a predetermined value corresponding to target amount of material removal from the work piece.

According to the method and the polisher of the present invention, the eddy current sensor in the cavity of the upper polishing plate measures distance from the senor to the upper surface of carrier with holes for the work pieces being inserted respectively. The measured distance is successively monitored and polishing is stopped when the distance has become a predetermined value corresponding to target amount of material removal from the work piece. Thus, the double side polisher according to the present invention can be used for polishing of such a work piece as a semiconductor wafer that is normally electrically non-conductive, without depending on electrical property thereof, and almost without being affected by wearing of the polishing pad. Therefore thickness control is achieved with high accuracy for long time.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of various embodiments of the invention, and therefore reference is made to the claims which follow the description for determining the scope of the invention.

BRIEF DESCRIPTION OF THE DRAWINGS

The accompanying drawings, which are incorporated in and constitute a part of the specification, illustrate embodiments of the invention and together with the description, serve to explain the principles of the invention.

DETAILED DESCRIPTION OF THE PREFERRED EMBODIMENTS

Figure 1:
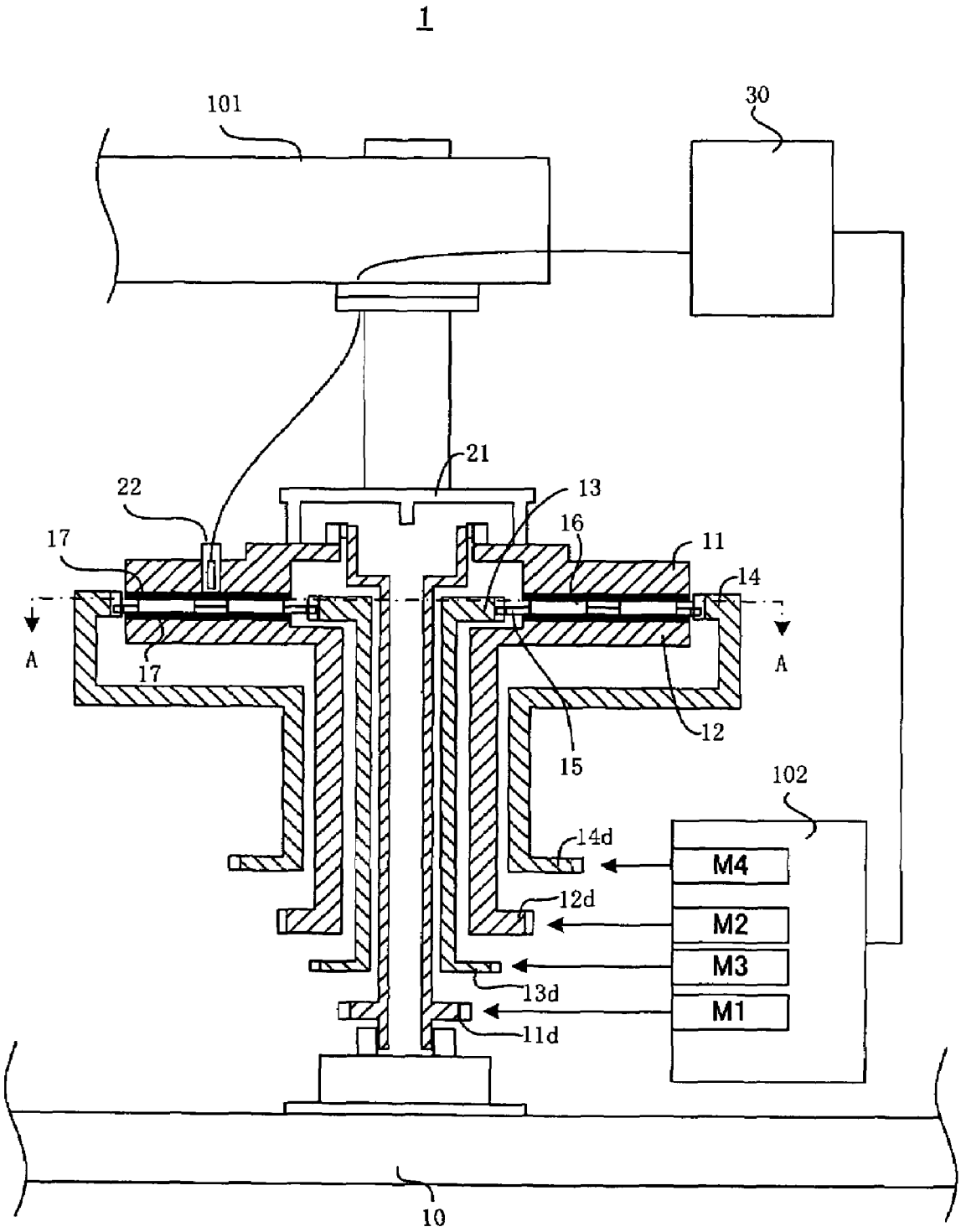
FIG. 1 is a vertical cross sectional view showing the substantial part of a double side polisher 1 according to the present invention.
Figure 2:
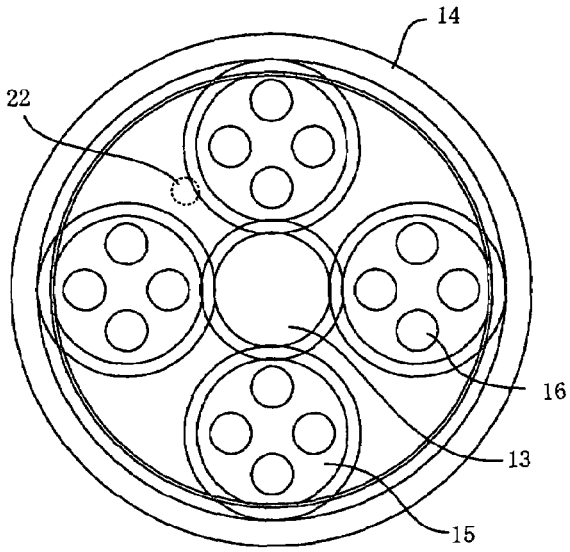
FIG. 2 is a plan view of FIG. 1 as seen from A—A.
Figure 3:
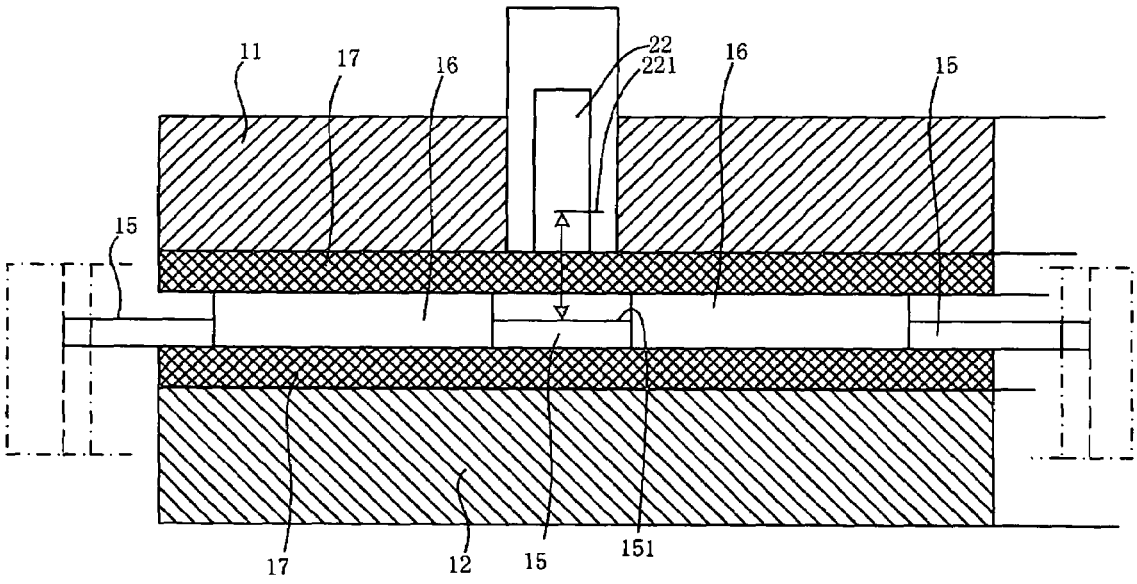
FIG. 3 is an enlarged view of the substantial part in FIG. 1.

Now, preferred embodiments of the present invention will be described in detail while referring to the accompanying drawings.

An upper polishing plate 11, a lower polishing plate 12, a sun gear 13, and an internal gear 14 are rotatably supported around the same axis line on a machine base 10. The upper polishing plate 11, lower polishing plate 12, sun gear 13, and internal gear 14 have integrally coupled drive gears: a first drive gear 11*d*, a second drive gear 12*d*, a third drive gear 13*d*, and a fourth drive gear 14*d* respectively, in order to transmit rotation power. To these gears, a rotation power is transmitted from a first motor M1, a second motor M2, a third motor M3, and a fourth motor M4 respectively. Although a drive unit 102 shown here consists of four motors, it is possible to drive respective gears with a single motor by distributing its power by means of a gear train.

A polishing pad made of nonwoven fabric or the like is attached or plastered on the lower flat surface of the upper polishing plate 11 and the upper flat surface of the lower polishing plate, and the polishing plates 11 and 12 are disposed so that the flat surfaces thereof face each other. In the gap between these surfaces is disposed a carrier 15. The carrier 15 thinner than the work piece 16 has external teeth meshing with the sun gear 13 and the internal gear 14.

The upper polishing plate 11 and the first drive gear 11*d* are arranged so that they can engage at lower position or disengage at upper position of the plates 11. It is possible to lift only the upper polishing plate 11 by an appropriate lifting means provided on a suspending member 21 and a beam 101. The carrier 15 is inserted from space created when the upper polishing plate 11 is lifted. At this time, the external teeth of the carrier 15 are engaged with the external teeth of the sun gear 13 and the internal teeth of the internal gear 14. The carrier 15 has a number of work piece holding holes in which flat work pieces 16 such as semiconductor wafers are mounted or inserted. Into the gap between the upper polishing plate 11 and the lower polishing plate 12, slurry is supplied from a slurry supply unit (not shown).

The upper polishing plate 11 has a cavity that opens downward and the eddy current sensor 22 is inserted therein. The eddy current sensor 22 is directed downward and measures a distance from the reference position 221 of the sensor 22 to an upper surface 151 of the carrier 15. The carrier, at least the upper surface thereof, is made of electrically conductive material. Since the position of the distance sensor 22 is known, it is possible to detect a distance to the carrier 15 relative to the upper polishing plate 11. The detection principle of the eddy current sensor itself is not described here, since it is described in the second document (Japanese Examined Patent Publication S63-9943. The control unit 30 monitors the amount of polishing based on the output of the eddy current sensor, and stops the drive unit 102 when polishing has progressed to a preset desired amount of polishing.

When polishing, the carrier 15 is placed on the lower polishing plate 12 to which the polishing pad 17 is attached; the external teeth of the carrier 15 are engaged with the sun gear 13 and internal gear 14. The work pieces 16 are inserted in the work piece holding holes of the carrier 15, and the upper polishing plate 11 is lowered. Then, slurry is supplied from a slurry supply unit into the gap between the upper and lower polishing plates 11, 12. The plates 11, 12, sun gear 13, and internal gear 14 are driven to rotate. The carrier 15 revolves around the sun gear 13 and rotates around the axis of itself as the carrier is meshed with the sun gear 13 and the internal gear 14. The upper and lower surfaces of the work pieces 16 are polished with the polishing pads of the plates 11, 12 by the planetary motion of the carrier 15, the rotation and polishing pressure of the plates 11, 12, and the slurry supplied. This polishing operation is a fairly standard operation and not special one.

The operation of the thickness control device for a double side polisher of this embodiment is described below using FIG. 5 and with reference to FIGS. 1 through 4.

When the thickness control operation starts (step S00), the operator is prompted to input an amount s0 of polishing, and then the amount is inputted (step S01). Here the amount "s0" is a target value obtained by subtracting the desired thickness of the work piece from the present thickness of the work piece measured previously. Then the upper polishing plate 11 lowers, the drive unit 102 and slurry supply unit start to run (S02). Then, the distance "d" from the eddy current sensor 22 to the upper surface of the carrier 15 is measured by the sensor 22 (S03). The measured value "d" is stored as an initial value "d0" (S04).

The distance "d" is measured again by the sensor 22 (S05), and the difference between the initial value "d0" and the current measured value "d" is calculated. This difference "d0−d" represents the total amount of polishing up to now, and is substituted for the current amount of polishing "s" (S06).

At the step S07, the value "s0" and "s" are compared. There if the value "s" is equal to the value "s0", then the control advances to the next step S08, else returns to the step S05. Thereby the steps S05 to S07 are repeated until determination "yes" is realized at the step S07. As the work pieces are continued to be polished throughout the repetitions of the steps, the work pieces have the target thickness "s0" at last.

Figure 4:
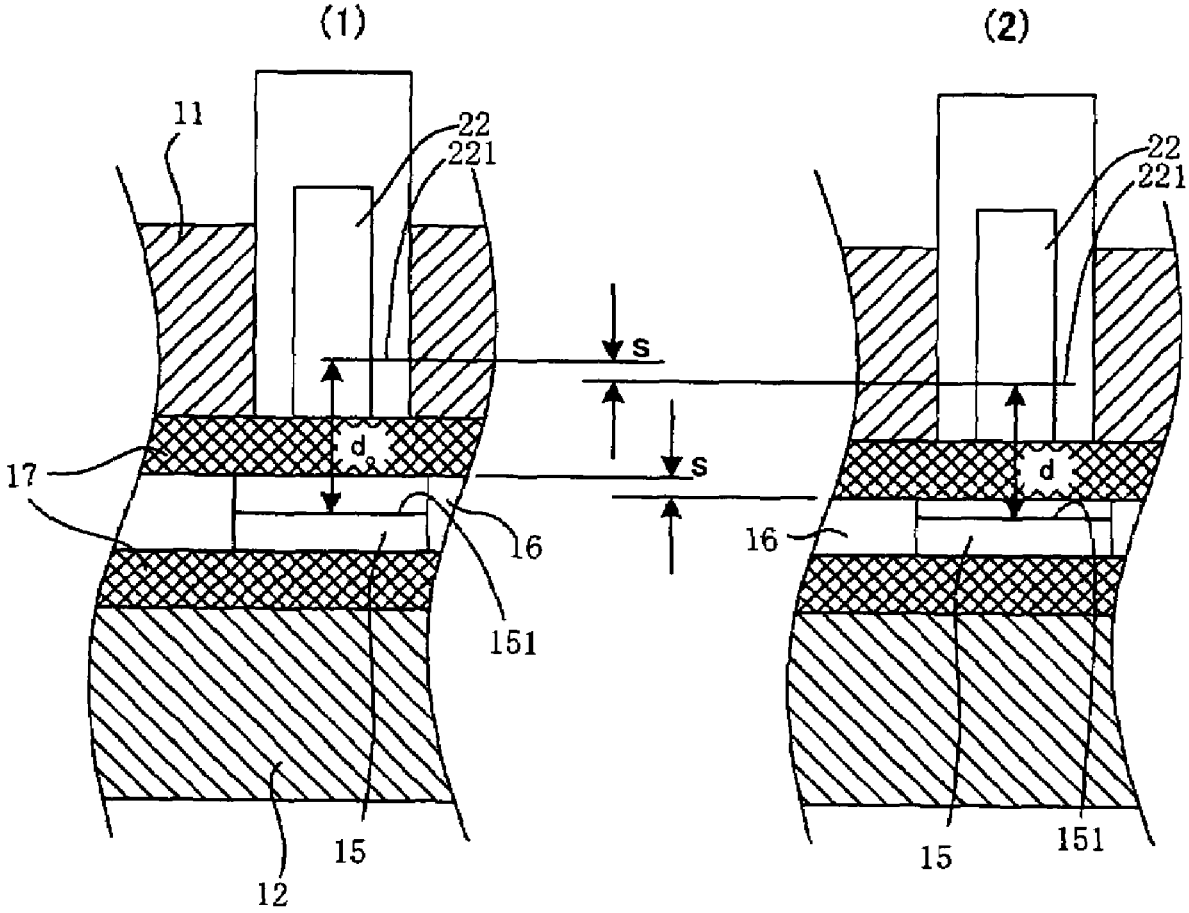
FIG. 4 is a comparative diagram illustrating a thickness control operation: (1) is a cross sectional view of the substantial part at the start of polishing and (2) is at the end of polishing.
Figure 5:
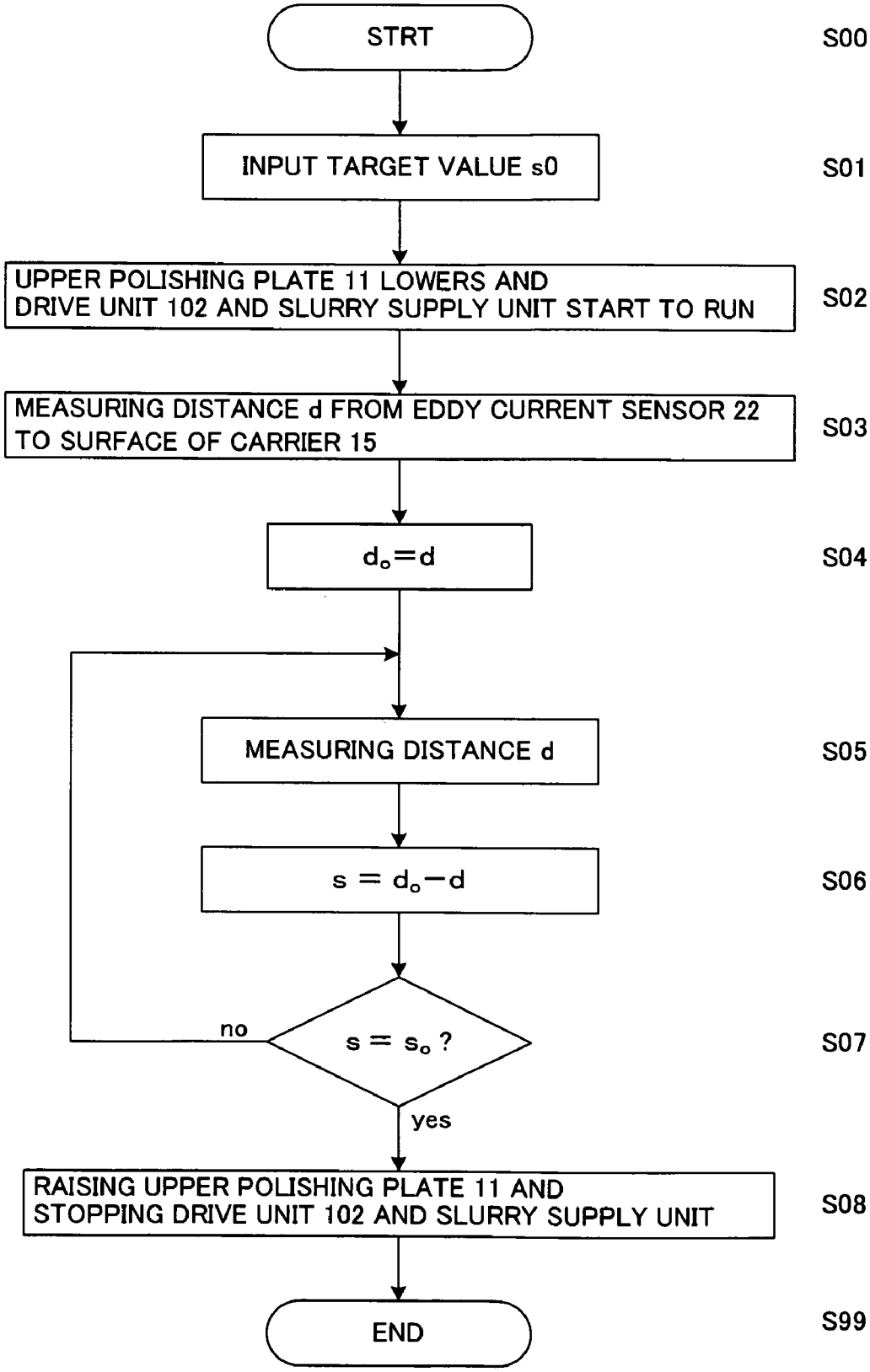
FIG. 5 is a flowchart describing the operation of a double side polisher of this embodiment including a calibration processing.

Describing this using FIG. 4, when polishing starts from the state shown at (1) of FIG. 4 and progresses to reach the state shown at (2), the upper polishing plate 11 moves down. This downward movement causes the eddy current sensor 22 fixed in the cavity of the upper polishing plate 11 to move down by the same amount "s". As the carrier 15 is kept in contact with the lower polishing plate 12 by gravitation, there decreases correspondingly the distance from the eddy current sensor 22 to the carrier surface 151. That is, change of the distance represents the amount of polishing.

Since the desired amount of polishing has been achieved, the drive unit 102 and slurry supply unit are stopped (S08), the upper polishing plate 11 is raised, and thus the polishing is finished. New work pieces are inserted after the finished work pieces are removed.

According to the thickness control method and the double side polisher of the present invention, the distance to the carrier surface is measured. Therefore the control is achieved without being affected by wear or deformation of the lower polishing pad and thereby accurate polishing can be performed. As the principle of the method is not dependent on electrical conductivity of the work piece, the method can be applied to polishing for work piece of non-electro-conductive material, such as a semiconductor wafer.

Although only preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. A thickness control method for a double side polisher, comprising:

providing a double side polisher comprising, a machine base, a lower polishing plate rotatably supported on the machine base and comprising a polishing pad disposed on an upper surface thereof, a sun gear comprising external teeth and rotatably supported on the machine base, an internal gear comprising internal teeth and rotatably supported on the machine base, an electro-conductive carrier comprising external teeth for engaging with the external teeth of the sun gear and the internal teeth of the internal gear and having holes for work pieces to be inserted therein, an upper polishing plate comprising a polishing pad disposed on a lower surface thereof and configured to apply a polishing pressure to the work pieces inserted in the holes, the upper polishing plate being rotatably supported on the machine base, a drive system for rotating the upper and lower polishing plates, the sun gear and the internal gear around the same axis, a slurry supplying unit for supplying a slurry to the work pieces, and an eddy current sensor mounted in a cavity of the upper polishing plate for measuring a distance from the sensor to an upper surface of the carrier;

placing the work pieces in the holes of the carrier;

supplying the slurry to the work pieces;

starting polishing the work pieces using the upper and lower polishing plates; and stopping the polishing when the distance to the upper surface of the carrier measured by the sensor is decreased by a predetermined value corresponding to a target amount of material removal from the work pieces.

2. A double side polisher comprising:

a machine base;

a lower polishing plate rotatably supported on the machine base and comprising a polishing pad disposed on an upper surface thereof;

a sun gear comprising external teeth and rotatably supported on the machine base;

an internal gear comprising internal teeth and rotatably supported on the machine base;

an electro-conductive carrier comprising external teeth for engaging with the external teeth of the sun gear and the internal teeth of the internal gear and having holes for work pieces to be inserted therein;

an upper polishing plate comprising a polishing pad disposed on a lower surface thereof and configured to apply a polishing pressure to the work pieces inserted in the holes, the upper polishing plate being rotatably supported on the machine base;

a drive system for rotating the upper and lower polishing plates, the sun gear and the internal gear around the same axis;

a slurry supplying unit for supplying a slurry to the work pieces;

an eddy current sensor mounted in a cavity of the upper polishing plate for measuring a distance from the sensor to an upper surface of the carrier;

an initial value storage unit to store an initial value of the distance from the sensor to the upper surface of carrier measured at a start of a polishing by the sensor;

a comparator unit for successively comparing the initial value stored in the initial value storage unit with values of the distance successively measured by the sensor; and a control unit for stopping the polishing when a difference between the initial value of the distance and a value of the distance measured after the start of the polishing calculated by the comparator unit reaches a predetermined value corresponding to a target amount of material removal from the work pieces.

* * * * *